United States Patent [19]

List et al.

[11] 3,933,142

[45] Jan. 20, 1976

[54] INTERNAL COMBUSTION ENGINE, PARTICULARLY A DIESEL ENGINE

[75] Inventors: Hans List; Rainer Cichocki; Karl Kirchweger; Friedrich Steinwandter, All of Graz, Austria

[73] Assignee: Hans List, Graz, Austria

[22] Filed: June 5, 1974

[21] Appl. No.: 476,515

[30] Foreign Application Priority Data

June 8, 1973 Austria ..... 5115/73

[52] U.S. Cl. .... 123/188 M; 123/52 M; 123/52 MC; 123/188 GC; 123/188 VA

[51] Int. Cl.[2] ..... F01L 3/00

[58] Field of Search ..... 123/188 M, 52 M, 52 MC, 123/188 VA, 188 GC

[56] References Cited

UNITED STATES PATENTS

| | | | |
|---|---|---|---|
| 2,921,571 | 1/1960 | Vogel | 123/188 M |
| 3,020,899 | 2/1962 | Mueller | 123/188 M |
| 3,273,551 | 9/1966 | Julien | 123/188 M |

FOREIGN PATENTS OR APPLICATIONS

| | | | |
|---|---|---|---|
| 41,348 | 7/1937 | Netherlands | 123/188 M |

*Primary Examiner*—Wendell E. Burns
*Assistant Examiner*—Daniel J. O'Connor
*Attorney, Agent, or Firm*—Watson, Cole, Grindle & Watson

[57] ABSTRACT

An internal combustion engine, in particular a Diesel engine, comprising at least one inlet duct consisting of a delivery portion and an adjoining duct portion wound spiral-fashion around the shaft of the associated intake valve, the upper wall of which bulges downwardly at the point of transition from the delivery portion to the spiral-shaped duct portion in such a manner that the cross-sectional area of the inlet duct is reduced above the valve diameter extending at a right angle in relation to the axis of the delivery portion.

3 Claims, 4 Drawing Figures

INTERNAL COMBUSTION ENGINE, PARTICULARLY A DIESEL ENGINE

Figure 1:
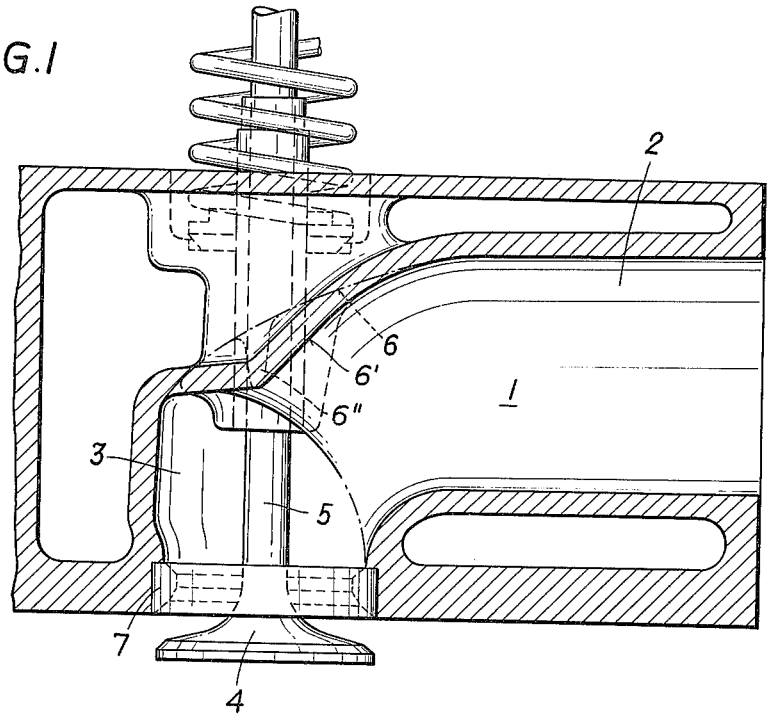

The invention relates to an internal combustion engine, particularly a Diesel engine, comprising at least one inlet valve for each cylinder, arranged in eccentric relation to the cylinder axis and connected to an inlet duct, said inlet duct consisting of a delivery portion and a duct portion adjoining same and wound around the valve stem in the shape of a spiral.

In a known internal combustion engine of this kind it is intended to provide an outflow distributed over the entire circumference of the valve clearance, of the combustion air admitted through the spiral duct into the cylinder, the individual flow components at the valve clearance presenting in relation to the cylinder axis a direction such as to produce the maximum contribution to the required rotation of the cylinder charge about the cylinder axis. In order to achieve these flow conditions, according to the known design the flow chamber adjoining the delivery portion of the inlet duct comprises two spiral-shaped subchannels oppositely directed about the valve axis and extending over different peripheral areas and reunited again at the lowest point of the duct cover. Consequently, as a result of these measures a reinforced overall twist of the cylinder charge is produced in the known type of internal combustion engine while largely avoiding objectionable flow components in opposition to the direction of the twist.

Recent developments in engine design, strongly influenced by considerations relating to environmental protection produced the conviction that in order to assure possibly complete combustion accompanied by beneficial effects for the composition of the exhaust gases not only adequate rotation but also vigorous turbulence of the cylinder charge is essential.

On the basis of these considerations it is the object of the present invention to produce reinforced turbulence of the cylinder charge for the purpose of reducing emissions in an internal combustion engine of the kind hereabove described by the simplest means possible. For that purpose, according to the invention the upper cover of the inlet duct presents a downward bulge or is provided with a rib thereby reducing the cross-sectional area, said reduction of the cross-sectional area being located at the point of transition between the delivery portion and the spiral-shaped duct portion and approximately above the valve diameter forming a right angle with the axis of the delivery portion. This reduction of the cross-sectional area in the region of the upper cover of the inlet duct produces a damming effect as a result of which the combustion air is discharged into the cylinder in the underlying area of the valve clearance at approximately the same velocity as in the opposite portion of the valve clearance but in an opposite direction in relation to the cylinder axis. In contrast with the conventional inlet duct arrangement, this helps to produce flow components that are effective in a sense opposed to the intended direction of twist for the ultimate purpose of producing inside the cylinder a collision of air layers rotating in an opposite sense accompanied by the formation of flows of vehement turbulence. The resulting considerable improvement of the mixture preparation tends to influence the combustion process and the composition of exhaust gases as mentioned above as an object of the present invention.

According to another embodiment of the invention the upper cover of the inlet duct is graded in the direction of the valve plane at the point where the crosssectional area is reduced. This design of the reduction of the cross-sectional area which is most convenient for the casting process offers a further advantage insofar as by varying the gradation pattern it is possible to essentially alter the distribution and exit velocity of the flow components over the entire valve clearance.

In particular, it is possible according to a further embodiment of the invention, to provide an upper cover of the inlet duct from the delivery portion to the point of transition to the spiral-shaped duct portion falling off with an increased bend towards the valve with the section of the cover area located in the spiral-shaped duct portion extending in an approximately perpendicular relation to the axis of the inlet valve or with an inclination towards the plane of the valve seat, the air layers passing along the upper cover being deflected towards the valve to a greater or lesser extent depending on the inclination of the cover area.

Figure 2:
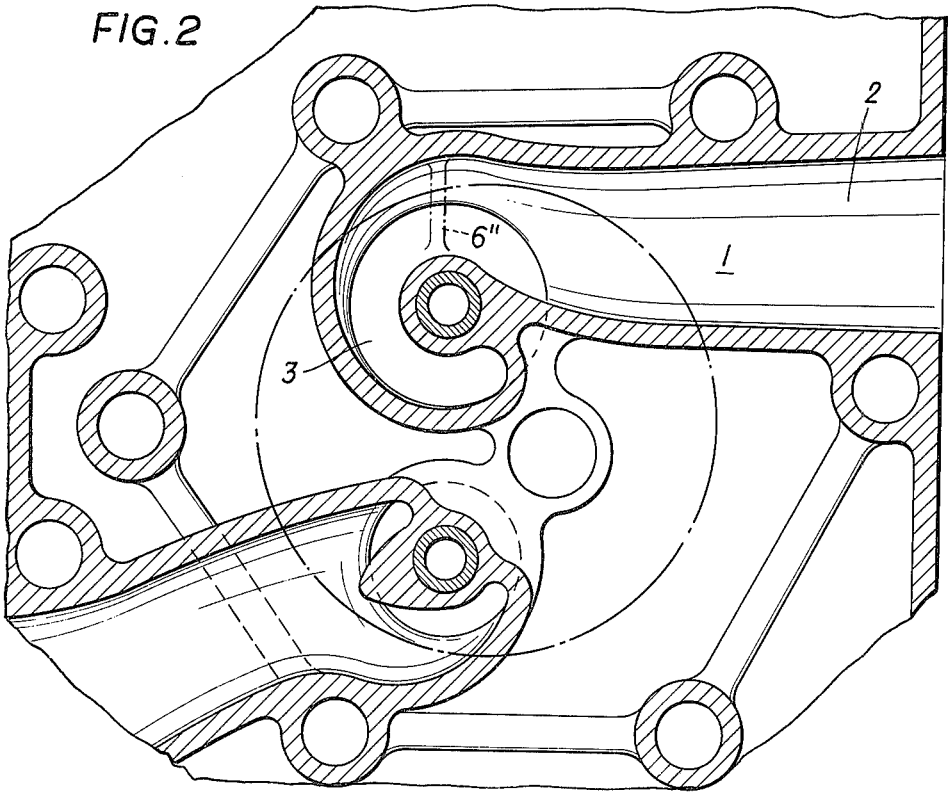
Figure 3:
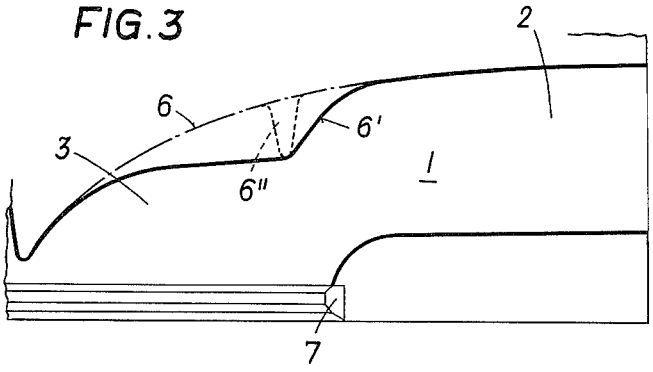
Figure 4:
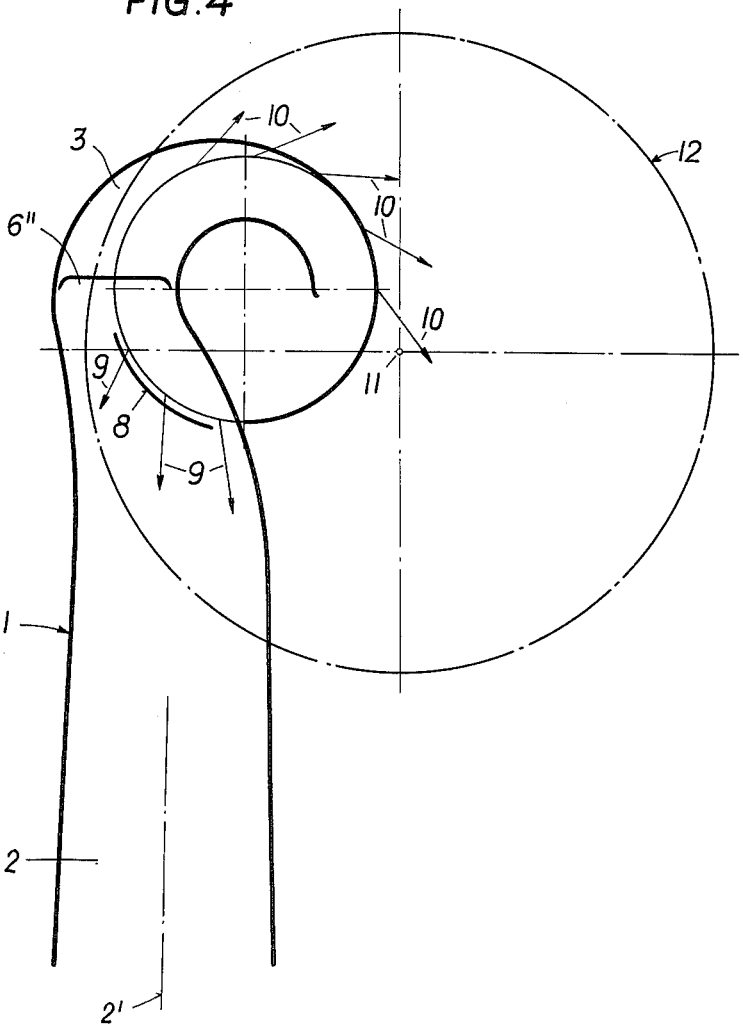

Further details of the invention will become apparent from the following description of an embodiment of the invention with reference to the accompanying drawing wherein FIG. 1 shows a cross-sectional view of a cylinder head according to the invention, the cross-section extending through the axis of the intake valve, FIG. 2 is a horizontal cross-sectional view of the cylinder head shown in FIG. 1, FIG. 3 a development following the main chamber line of the inlet duct shown in FIGS. 1 and 2, and FIG. 4 a diagrammatic view of the outflow conditions in an exhaust valve according to FIGS. 1 to 3.

The inlet duct 1 of the cylinder head only partially shown in the drawing is a spiral duct comprising in a manner known per se a generally elongated delivery portion 2 and an adjoining duct portion 3 wound spiral-fashion about the shaft 5 of the intake valve 4 and falling off towards the valve.

The line indicated by a dot-and-dash line in FIG. 1 illustrates the usual pattern of the upper cover area 6 of an inlet duct 1 at the point of transition between the delivery portion 2 and the spiral-shaped duct portion 3. As the development in FIG. 3 clearly shows, the upper cover area 6 progressively falls off towards the valve seat 7 in an harmonic curve. Although spiral ducts of this conventional design produces an exit for the combustion air over the greater part of the valve clearance with several flow components flowing in opposite direction to the intended sense of rotation of the cylinder charge in relation to the cylinder axis, yet the delivery portion 2 of the inlet duct 1 imparts a certain unidirectional effect to the air, so that such peripheral parts of the valve which has produced opposite flow components will be impinged upon to a lesser extent only. These flow conditions met with the formerly prevalent requirements calling for a maximum twist of the air for combustion in the cylinder.

In accordance with the invention, however, the formation of flow components directed in opposition to the desired sense of rotation of the cylinder charge is to be facilitated. For the purpose, a reduction of the cross-sectional area is produced at the transition from the delivery portion 2 to the spiral-shaped duct portion 3 either by bulging the upper cover area 6′ (indicated by a solid black line) by graded steps at this point in the direction of the valve 4 or by providing a rib 6'' protruding from the upper cover area 6 towards the valve 4 and located approximately above the valve diameter extending at a right angle in relation to the axis of the delivery portion 2 of the inlet duct 1 (indicated by dash-dot lines in FIG. 1).

By the graded recess in the upper cover area 6' and/or by the rib 6'' a damming effect is produced as a result of which the air for combustion entering via the delivery portion is partly deflected towards the underlying area of the valve clearance, so that the flow components 9 emerging in the peripheral part 8 (FIG. 4) through the valve clearance are imparted discharge velocities which are as high as those of the flow components 10 emerging on the opposite side of the valve clearance and producing with reference to FIG. 4 a clockwise rotation of the cylinder charge in relation to the cylinder axis 11. Inside the cylinder 12 a collision occurs between the air layers produced by the flow components 9 and 10 and flowing in opposite senses of rotation, said collision being accompanied by a high degree of turbulence.

The intensity of the counter-flow produced by the components 9 can be varied as required by the appropriate shaping of the graded recess in the upper cover area 6' and/or by the appropriate design and positioning of the rib 6''.

I claim:

1. An internal combustion eninge, in particular a Diesel engine, comprising at least one inlet valve for each cylinder, arranged in eccentric relation to the cylinder axis, an inlet duct connected to said inlet valve and comprising a delivery portion and an adjoining spiral-shaped duct portion, said inlet valve having a valve stem extending through the spiral-shaped duct portion, said inlet duct having a reduction of the cross-sectional area formed by a portion of an upper duct wall comprising a stepped portion or rib protruding into the inlet duct at the point of transition from the delivery portion to the spiralshaped duct portion and extending in transverse relation to the direction of the delivery portion.

2. An internal combustion engine according to claim 1, wherein the stepped portion comprises a first upper duct wall portion extending from the delivery portion to the point of transition to the spiral-shaped duct portion and sloping off towards the inlet valve with an increasing curvature, and a second upper duct wall portion adjacent the first upper duct wall portion and extending approximately in a perpendicular relation to the axis of the inlet valve.

3. An internal combustion engine according to claim 1, wherein said stepped portion comprises a first upper duct wall portion extending from the delivery portion to the point of transition to the spiral-shaped duct portion and sloping off towards the inlet valve with an increasing curvature, and a second upper duct wall portion adjacent the first upper duct wall portion and extending in an inclined relation to the plane of the valve seat.

* * * * *